United States Patent [19]

Borking et al.

[11] 4,415,119

[45] Nov. 15, 1983

[54] BOILER

[75] Inventors: Lars-Olof Borking; Ragnar Bernstein, both of Fagersta, Sweden

[73] Assignee: Fagersta AB, Fagersta, Sweden

[21] Appl. No.: 370,376

[22] Filed: Apr. 21, 1982

Related U.S. Application Data

[63] Continuation-in-part of Ser. No. 259,561, May 1, 1981, abandoned.

[30] Foreign Application Priority Data

Apr. 1, 1981 [SE] Sweden ..... 8102104

[51] Int. Cl.[3] ..... F24D 3/08; F22B 5/00

[52] U.S. Cl. ..... 237/19; 122/16; 122/19

[58] Field of Search ..... 122/13 R, 14, 16–19; 237/19

[56] References Cited

U.S. PATENT DOCUMENTS

| | | | |
|---|---|---|---|
| 1,070,175 | 8/1913 | Ponninghams | 122/16 |
| 1,958,736 | 5/1934 | Barrow | 237/19 |
| 2,683,442 | 7/1954 | Karlen | 122/19 |
| 2,704,188 | 3/1955 | Bergmann | 237/19 |
| 2,937,625 | 5/1960 | Meyers | 122/16 |
| 4,175,698 | 11/1979 | Brosenius | 237/19 |
| 4,222,350 | 9/1980 | Pompei et al. | 122/32 |

FOREIGN PATENT DOCUMENTS

| | | | |
|---|---|---|---|
| 2260759 | 9/1975 | Fed. Rep. of Germany | 237/19 |
| 2029555 | 3/1980 | United Kingdom | 237/19 |

*Primary Examiner*—Henry C. Yuen

*Attorney, Agent, or Firm*—Murray Schaffer

[57] ABSTRACT

A boiler for heating a heat-transfer medium, such as water in a domestic heating system with water-carried heat. The boiler comprises a tank (2) for the radiator water; a combustion chamber (3); combustion-gas pipes (4) which extend down through the tank and which discharge at the bottom thereof in a collecting chamber (5) for combustion gases. At the upper part of the tank (2) there is arranged an outlet (7) to the radiators, while a tank-inlet (8) from the radiators is arranged at the lower part of the tank. Also arranged in the tank (2) is a reservoir (17,20) for heating tap water, whereat the reservoir-inlet (10) for tap water is connected to a fresh cold-water pipe and is located at a level which lies beneath that of the tank inlet (8) from the radiators.

The tap water reservoir has a lower part (20) which is located beneath the combustion chamber in the tank, this part of the reservoir having a branch point (11) from which a first branch pipe (12) passes outside the tank to a mixer valve (13) and is arranged to supply pre-heated tap water thereto, and from which a second branch pipe (14) passes to the mixer valve (13) via an upper part (17) of the tap water reservoir lying above the combustion chamber (3), and is arranged to supply to the mixer valve tap water having a higher temperature than that of the tap water supplied by said first branch pipe (12).

6 Claims, 3 Drawing Figures

BOILER

RELATED APPLICATION

Figure 1:
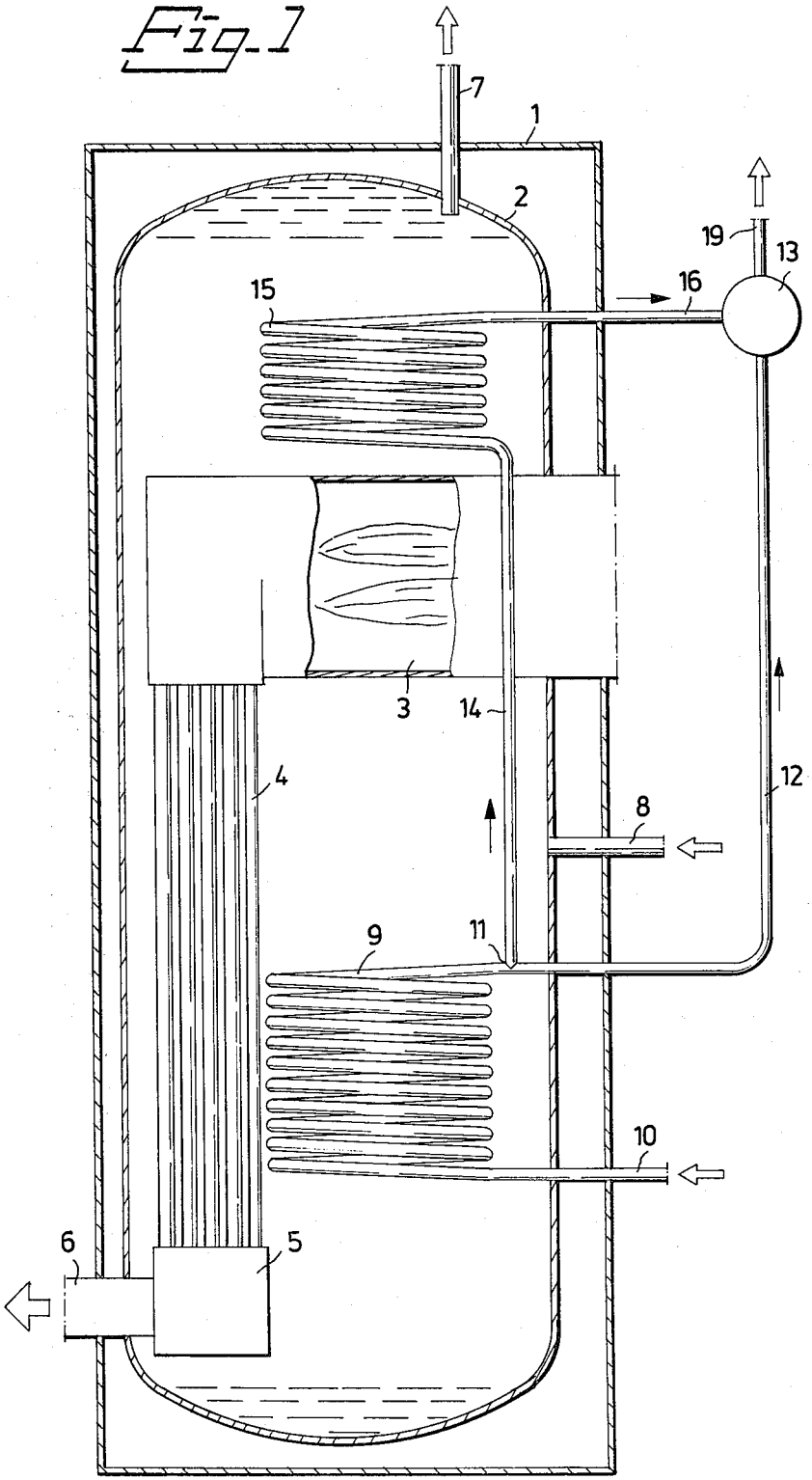
Figure 9:
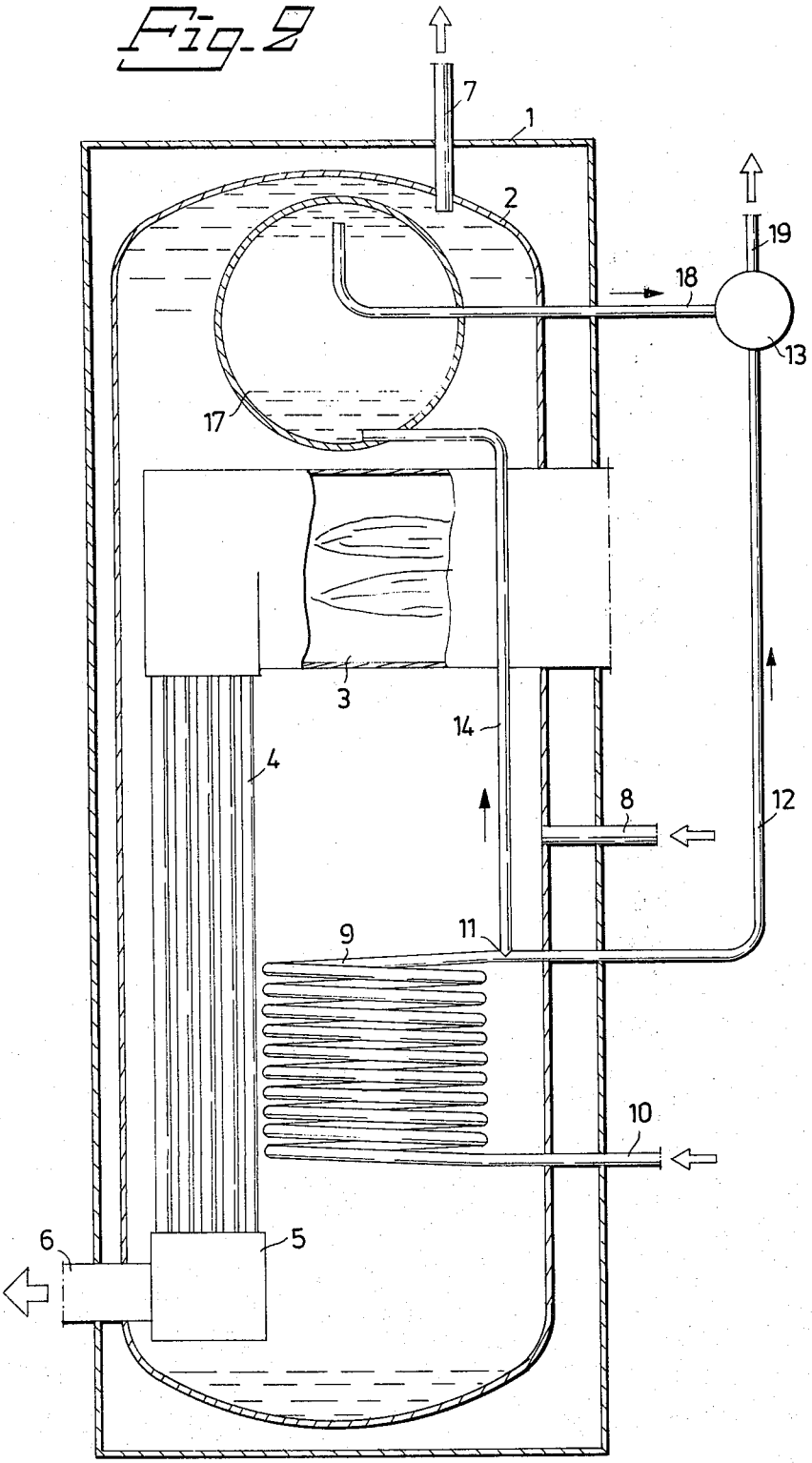

This is a continuation-in-part of application Ser. No. 259,561, filed May 1, 1981, now abandoned.

The present invention relates to a boiler for heating a heat-transfer medium, such as water, in a heating system with water-carried heat, said boiler comprising a tank for the heat-transfer medium; a combustion chamber in heat-conductive connection with the heat-transfer medium in the tank; combustion-gas pipes which extend from the combustion chamber down through the tank and which discharge at the bottom thereof in a collecting chamber for combustion gases; an outlet at the top of the tank to the feed line of the heating system; an inlet from the return line or outfeed line of said system; and a reservoir in the tank for heating tap water, whereat the reservoir-inlet for tap water is connected to a fresh cold-water pipe and is located at a level which lies beneath that of the inlet of the outfeed line from said heating system.

The hot water from the hot-water reservoir of a boiler shall normally be held at a temperature of about 60° C. at the tap location. This is achieved by mixing hot water in the hot-water reservoir, which water has a temperature of about 80° C., with cold water taken from a fresh water pipe, in a mixer valve, the temperature of the cold water being about 7° C.

One disadvantage encountered when mixing hot water from a hot-water reservoir with cold water from a fresh water pipe is that the hot-water reservoir may be completely emptied when large quantities of hot water are used.

The object of the present invention is to provide a boiler in which the risk of all the hot water in the hot-water reservoir being used is considerably reduced.

To this end there is provided in accordance with the invention a boiler of the kind described in which the tap water reservoir located within the tank has arranged at its lower part, which is located beneath the combustion chamber, a branch point from which a first branch pipe passes outside the tank to a mixer valve and is arranged to supply pre-heated tap water thereto and a second branch pipe passes to said mixer valve via an upper part of the tap water reservoir and is arranged to supply to said valve tap water having a higher temperature than that of the tap water supplied by said first branch pipe.

In the boiler according to the invention, the lowest portion of the tap water lower part in the tank for the heat-transfer medium is located beneath the heat-transfer medium return inlet, so as to obtain a cold, stably layered bottom zone in which the combustion gases in the combustion-gas pipes can be cooled to the lowest temperature possible, and so that the greatest possible amount of condensation is formed, for achieving the maximum possible heat transfer (heat output) from said gases. Because, in accordance with the invention, all the hot water taken out through the tap is caused to pass through this cold, layered bottom zone in said tank, the effect of said layered zone is increased and the coldest possible bottom zone is obtained in the tank.

Figure 3:
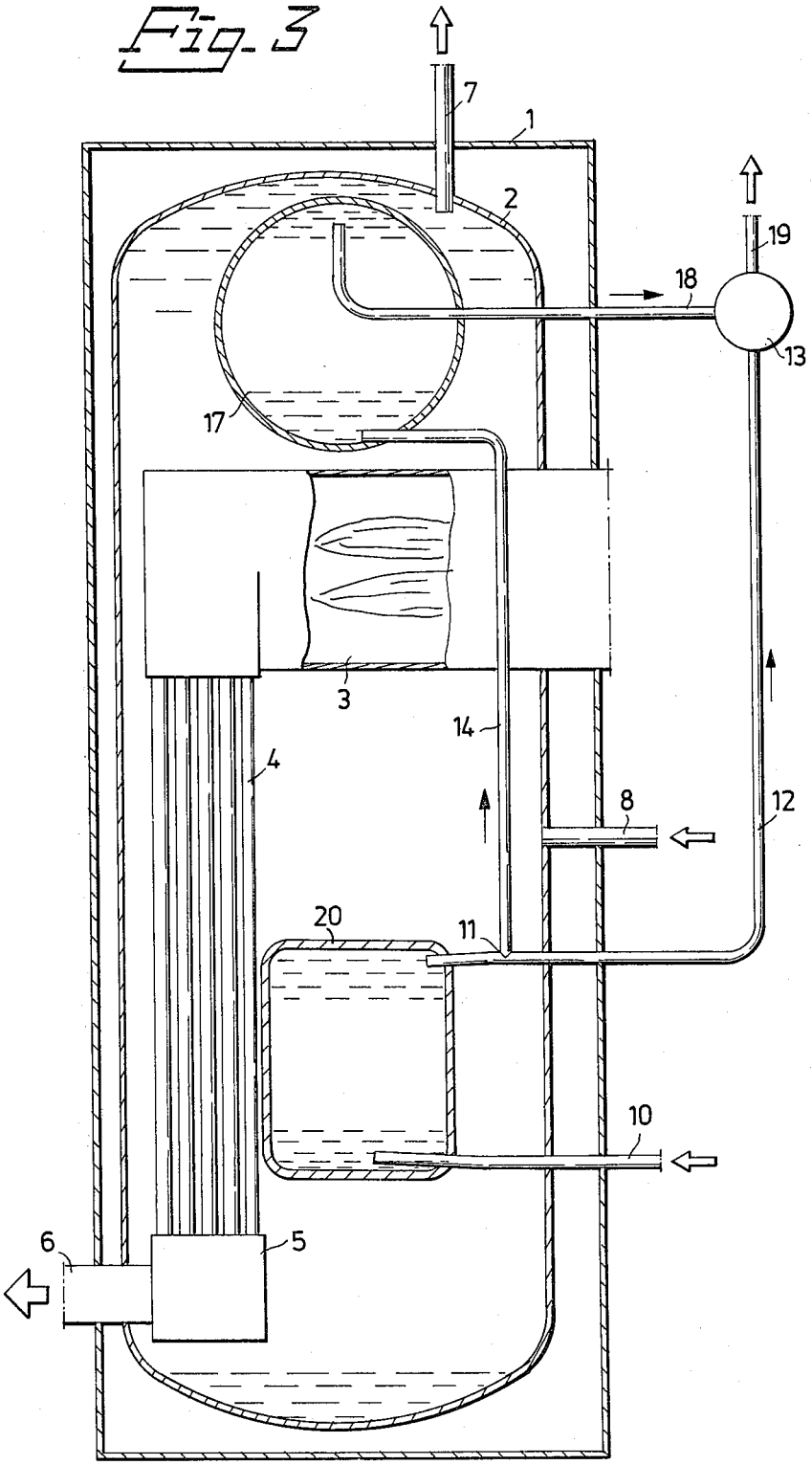

The invention will now be described in more detail with reference to the accompanying drawing, in which FIG. 1 is a longitudinal sectional view of a first exemplary embodiment of the invention, FIG. 2 is a longitudinal sectional view of a second exemplary embodiment of the invention and FIG. 3 is a longitudinal sectional view of a third exemplary embodiment of the invention.

Corresponding elements of the embodiments have been identified by the same references. The boiler illustrated in FIGS. 1, 2 and 3 includes a boiler casing 1 which encloses a tank 2 for a heat-transfer medium, which in the illustrated case is assumed to be water. Arranged within the tank 2 is a combustion chamber 3 from which combustion-gas pipes 4 extend down to a combustion-gas collecting chamber 5 at the bottom of the tank. A waste-gas exhaust pipe 6 passes from the collecting chamber 5 to a chimney (not shown). The upper part of the tank 2 has an outlet 7, which is connected to the inlet pipe of the heating system, while arranged at the lower part of said tank is an inlet 8 connected to the return pipe of said system. In the embodiments according to FIGS. 1 and 2 there is arranged within the tank 2 a pipe coil 9 for heating tap water. In the embodiment according to FIG. 3 there is arranged within the tank 2 instead a reservoir 20 for the heating of the tap water. As shown in the drawing, the tap water inlet 10, which is connected to a fresh cold water supply pipe, lies beneath the level of the inlet 8 from the return pipe of the system. The coil 9 and reservoir 20 have arranged at the upper portion thereof, which is located beneath the combustion chamber 3, a branch point 11 from which a first branch pipe 12 extends externally of the tank 2 to a mixer valve 13, and from which a second branch pipe 14 communicates with said valve via an upper part 15 of the coil of the FIG. 1 embodiment, and supplies to the mixer valve 13 through a pipe 16 water which has been heated to a higher temperature than the water supplied through the pipe 12. In the FIG. 2 and FIG. 3 embodiments, the branch pipe 14 discharges into a hot-water reservoir 17, from where the tap water of higher temperature is fed to the mixer valve 13 through a pipe 18.

The cold fresh water entering through the inlet 10 of the tap water coil 9 and the tap water reservoir 20 has a temperature of about 7° C. and the water is heated to about 25° C. when it reaches the branch point 11. The water in the pipe 12 thus has a temperature of about 25° C. when it reaches the mixer valve 13. The temperature of the tap water in the upper part 15 of the coil 9 of the FIG. 1 embodiment and in the hot-water reservoir 17 of the FIG. 2 and FIG. 3 embodiments has a temperature of about 80° C. Thus water having a temperature of about 25° C. is mixed in the mixer valve 13 with water heated to a temperature of about 80° C. so that the water passing from the valve 13 to the tap location through pipe 19 has a temperature of about 60° C. A tap water coil and reservoir constructed in accordance with the invention affords two important advantages. Firstly, there is obtained an improved layered cold zone in the lower part of the tank 2, whereby the heat contained in the combustion gases flowing down through the pipes 4 can be recovered more effectively, since the colder water mixed with the hot water always passes through said zone, which is not the case with conventional boilers, where the hot water is mixed directly with the cold fresh water. Secondly, the hot water in the upper part 15 of the tap water coil or in the hot-water reservoir 17 will last longer than with conventional boilers, since less hot water need be mixed in the mixer valve 13 to obtain a hot-water temperature of 60° C. at the tap location.

We claim:

1. A boiler for a heating system and hot water supply system comprising a tank (2) for holding a heat-transfer medium, a combustion chamber (3) located within said tank in heat-conductive contact with the heat-transfer medium, a plurality of combustion-gas exhaust pipes (4) extending from the combustion chamber downwardly through said tank, and a collecting chamber (5) connected to the lower end of said exhaust pipes having a discharge outlet (6); an outlet (7) for said heat-transfer medium at the top of said tank for passing the heat-transfer medium to the infeed line of the heating system and a return inlet (8) below said combustion chamber from the outfeed line of said heating system, and; a primary reservoir (9;20) located in said tank below said combustion chamber having a lower portion located beneath said return inlet and a reservoir inlet (10) connected to a supply of fresh water and a reservoir outlet comprising a first branch (12) extending to a mixer value (13) and a second branch (14) passing to a secondary reservoir (15;17), said secondary reservoir having an outlet (16;18) to said mixer value (13) arranged to supply fresh water having a higher temperature than that supplied from said first branch pipe (12), said mixer value being connected to said hot water supply system (19).

2. A boiler according to claim 1, characterized in that said primary reservoir consists of a pipe coil (9).

3. A boiler according to claim 1 or 2, characterized in that said secondary reservoir consists of a pipe coil (15).

4. A boiler according to claim 1, characterized in that said primary reservoir inlet (10) is located beneath said return line inlet (8).

5. A boiler according to claim 1, characterized in that said first branch (12) of the primary reservoir outlet extends outside the tank (2) to the mixer valve (13).

6. A boiler according to claim 1, characterized in that said secondary reservoir (15;17) is located above the combustion chamber (3).

* * * * *